US009384913B2

(12) United States Patent
Roehrig et al.

(10) Patent No.: US 9,384,913 B2
(45) Date of Patent: Jul. 5, 2016

(54) LOCKING MECHANISM FOR A SWITCH-ON BUTTON OF A CIRCUIT BREAKER

(71) Applicant: SIEMENS AKTIENGESELLSCHAFT, Munich (DE)

(72) Inventors: Fabian Roehrig, Berlin (DE); Bastian Schauer, Zeuthen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 102 days.

(21) Appl. No.: 14/362,176

(22) PCT Filed: Nov. 15, 2012

(86) PCT No.: PCT/EP2012/072683

§ 371 (c)(1),
(2) Date: Jun. 2, 2014

(87) PCT Pub. No.: WO2013/079328

PCT Pub. Date: Jun. 6, 2013

(65) Prior Publication Data

US 2014/0353133 A1 Dec. 4, 2014

(30) Foreign Application Priority Data

Dec. 1, 2011 (DE) ..... 10 2011 087 551

(51) Int. Cl.
*H01H 1/52* (2006.01)
*H01H 3/20* (2006.01)
(Continued)

(52) U.S. Cl.
CPC . *H01H 9/20* (2013.01); *H01H 9/24* (2013.01); *H01H 13/02* (2013.01); *H01H 71/58* (2013.01); *H01H 2003/3057* (2013.01); *H01H 2235/01* (2013.01)

(58) Field of Classification Search
CPC ..... H01H 9/20; H01H 13/02; H01H 9/24; H01H 71/58
USPC ..... 200/318, 400, 323, 337, 43.11, 43.16; 335/167, 6
See application file for complete search history.

(56) References Cited

U.S. PATENT DOCUMENTS 4,506,121 A * 3/1985 Peterson ..... H01H 9/20 200/401
4,879,438 A 11/1989 Winchester
(Continued)

FOREIGN PATENT DOCUMENTS

CN 1308767 A 8/2001
DE 598210 C 6/1934
(Continued)

OTHER PUBLICATIONS

Boettinger, Auto-interrupter with pressure controller and movable contact element, Jun. 1934. Machine translation.*

*Primary Examiner* — Kyung Lee
(74) *Attorney, Agent, or Firm* — Laurence Greenberg; Werner Stemer; Ralph Locher

(57) ABSTRACT

In order to form a locking mechanism for a switch-on button of a circuit breaker which has a simple and inexpensive configuration, the locking mechanism has a locking element which is mounted rotatably on the switch-on button. The locking element, held directly in a first position by a first spring, enables actuation of the switch-on button and, directly in the switched-on state of the circuit breaker by a second spring, can be moved into a second position. The switch-on button of the circuit breaker is locked to prevent actuation in the second position.

3 Claims, 3 Drawing Sheets

(51) Int. Cl.

| | |
|---|---|
| ***H01H 9/20*** | (2006.01) |
| ***H01H 9/24*** | (2006.01) |
| ***H01H 71/58*** | (2006.01) |
| ***H01H 13/02*** | (2006.01) |
| *H01H 3/30* | (2006.01) |

(56) References Cited

U.S. PATENT DOCUMENTS

| | | | | |
|---|---|---|---|---|
| 5,886,603 | A * | 3/1999 | Powell | H01H 9/16 200/318 |
| 5,959,518 | A | 9/1999 | Passow | |
| 6,031,195 | A * | 2/2000 | Meili | H01H 71/462 200/318 |
| 2001/0006365 | A1 * | 7/2001 | Yu | H01H 73/30 337/68 |
| 2002/0100667 | A1 * | 8/2002 | Leccia | H02B 11/133 200/50.21 |
| 2006/0042922 | A1 * | 3/2006 | Aber | H01H 71/0228 200/430 |
| 2010/0078298 | A1 | 4/2010 | Freundt et al. | |

FOREIGN PATENT DOCUMENTS

| | | | |
|---|---|---|---|
| DE | 725159 | C | 9/1942 |
| DE | 1050433 | B | 10/1956 |
| DE | 1050433 | B | 2/1959 |
| DE | 19817692 | C1 | 7/1999 |
| DE | 29816673 | U1 | 10/1999 |
| DE | 102004045937 | A1 | 4/2006 |
| DE | 102005038629 | B3 | 12/2006 |
| DE | 102009011766 | A1 | 9/2009 |
| EP | 0987724 | A2 | 3/2000 |
| GB | 486062 | A | 5/1938 |

* cited by examiner

LOCKING MECHANISM FOR A SWITCH-ON BUTTON OF A CIRCUIT BREAKER

BACKGROUND OF THE INVENTION

1. Field of the Invention

The invention relates to a locking mechanism for a switch-on button of a circuit breaker.

A locking mechanism for a switch-on button of a circuit breaker is known from DE 10 2005 038 629. The therein disclosed locking mechanism for the switch-on button of the circuit breaker comprises a force transmission element for transmitting the force exerted on the switch-on button at switch-on to a tripping mechanism, which force transmission element is swiveled away in the case of a switched-on circuit breaker so that the switch-on button cannot initiate re-actuation.

2. Brief Summary of the Invention

The object of the present invention is to implement a locking mechanism of simple and inexpensive design for a switch-on button of a circuit breaker.

This object is achieved according to the invention by a locking mechanism for a switch-on button of a circuit breaker, which locking mechanism has a locking element rotatably mounted on the switch-on button, which locking element, retained in a first position directly by a first spring, allows the switch-on button to be actuated and, in the switched-on state of the circuit breaker, can be moved directly by a second spring to a second position, wherein in the second position the switch-on button of the circuit breaker is locked against actuation.

Such an implementation of a locking mechanism for the switch-on button of a circuit breaker has a simple and inexpensive design because, due to the rotatable mounting of the locking element on the switch-on button and the direct positioning in a first or second position, as the case may be, by a first or second spring, only a small number of components are used to implement effective locking of a switch-on button and therefore reliably prevent re-actuation of the switch-on button in the case of an already switched-on circuit breaker. In other words, with such a locking mechanism a so-called reclosure interlock is implemented whereby, with the circuit breaker already ON and the closing spring of the stored-energy spring mechanism re-loaded, re-actuation of the switch-on button is prevented.

In an advantageous embodiment of the invention, the first spring engages with the switch-on button and the locking element.

In another advantageous embodiment of the invention the second spring engages with the locking section and a switch shaft lever of the circuit breaker.

In another advantageous embodiment of the invention, a locking bolt of the locking element engages in a locking recess of a support plate of the circuit breaker in the second position of the locking element.

Such arrangements of a first spring and second spring and of a locking bolt on the locking element, said locking bolt engaging in a locking recess of the support plate of the circuit breaker, provide a simple means of implementing an effective reclosure interlock for a circuit breaker of this kind, wherein a force exerted by the second spring in the second position of the locking element is greater than a force exerted by the first spring on the locking element in the second position as long as the circuit breaker is in its ON state, so that during this state the locking or more specifically the reclosure interlock is reliably maintained.

BRIEF DESCRIPTION OF THE SEVERAL VIEWS OF THE DRAWING

The invention will now be explained in greater detail on the basis of the drawing and an exemplary embodiment with reference to the accompanying figures, in which:

FIG. 6 shows the locking mechanism in a second, locked state with the circuit breaker ON.

DESCRIPTION OF THE INVENTION

Figure 1:
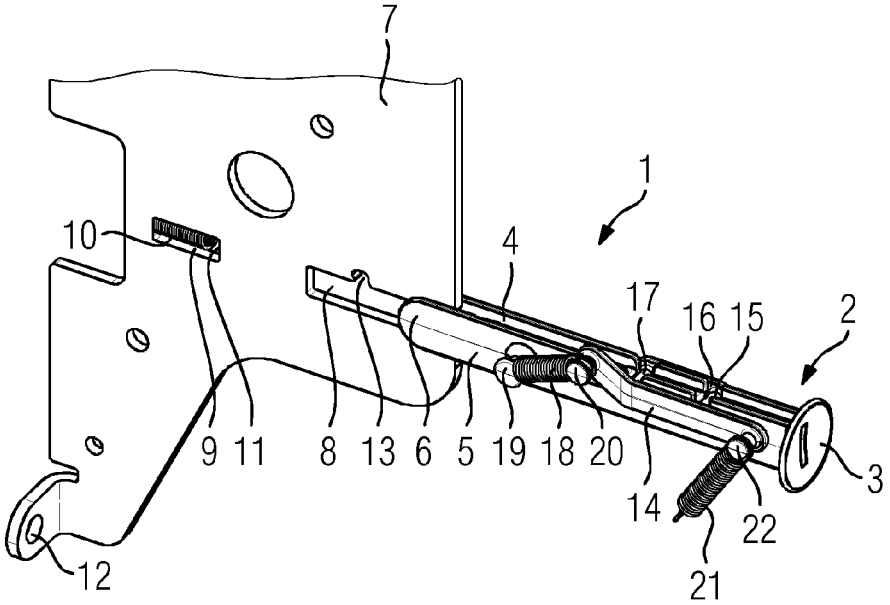
FIG. 1 shows a three-dimensional view of a locking mechanism according to the invention prior to assembly.

FIG. 1 shows a locking mechanism 1 for a switch-on button 2 of a circuit breaker (not depicted in further detail), wherein the switch-on button 2 is designed to close the circuit breaker, which circuit breaker has, for example, a stored-energy spring mechanism comprising a closing spring. With circuit breakers of this kind, the closing spring is re-loaded after a switch-on operation in order to be ready for a subsequent switching operation. In this state, with the circuit breaker ON and the closing spring already re-loaded, re-actuation of the switch-on button and therefore open-circuiting is reliably prevented. The switch-on button 2 in this described state of the circuit breaker must be locked against re-switching by means of the locking mechanism 1. The switch-on button 2 has an actuator 3 with which an operator can actuate the switch-on button to switch the circuit breaker on. The switch-on button 2 additionally has two guide bars 4 and 5 having an actuation end 6, wherein the guide bars 4 and 5 are disposed around a support plate 7 of the circuit breaker and the actuation end 6 is designed to actuate a mechanism for releasing the closing spring and switching on the circuit breaker (not depicted in greater detail here). For this purpose the support plate 7 has a first recess 8 and a second recess 9. The second recess 9 is designed to accommodate a compression spring 10 and latching means of the switch-on button 2, wherein the latching means are provided as an end stop of the switch-on button 2 at a first stop 11 of the second recess 9 and the compression spring 10 is designed to return the switch-on button 2 to its original position following execution of a switching operation. The support plate 7 additionally has fastening means 12 for fixing to a base plate of the circuit breaker. In the first recess 8, a locking recess 13 is provided which interacts with a locking element 14 rotatably mounted on the switch-on button, said locking element 14 being rotatably mounted on a bearing 15 in a recess 16 of the switch-on button and having a locking bolt 17 which, in a second position of the locking element 14, engages in the locking recess 13 of the support plate 7, wherein, in the second position of the locking element 14, the circuit breaker is in its ON state with the closing spring already re-loaded. For this purpose the locking element 14 is held pre-loaded in a first position on the switch-on button 2 by means of a first spring 18, said first spring being fastened to a first dome 19 of the switch-on button and to a second dome 20 of the locking element and pre-loaded such that the locking element is in the first position shown in FIG. 1 in which the locking bolt, when actuated, cannot engage in the locking recess 13. A second spring 21 is fastened to a third dome of the locking element 14 and switch shaft lever (not visible in FIG. 1), said second spring 21, in the first position of FIG. 1, having a low loading such that a force of the second spring 21 is less than a force exerted by the first spring 18 on the locking element 14.

Figure 2:
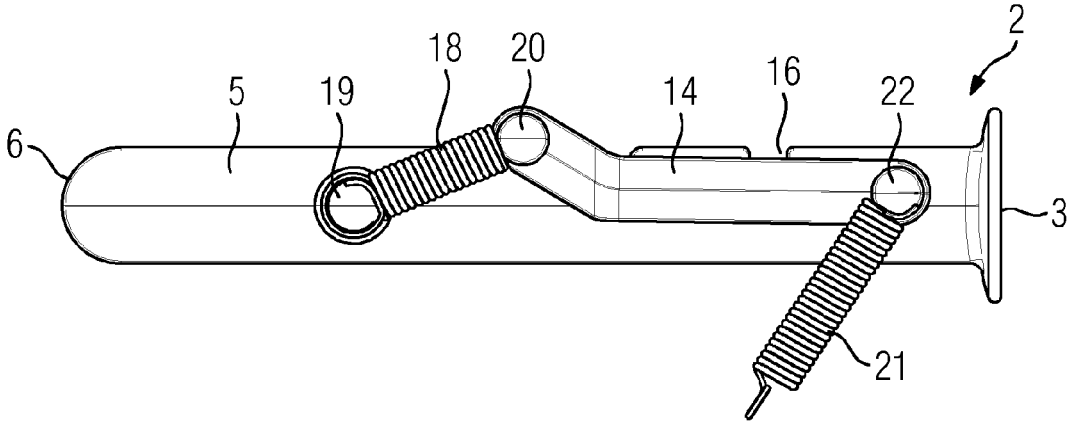
FIG. 2 shows a side view of a switch-on button of the locking mechanism from FIG. 1.

FIG. 2 shows a side view of the switch-on button 2 with its actuator 3, its actuation end 6 and the locking element 14 in its first position, said locking element being held in this position via the first spring 18 as long as the circuit breaker is in its switched-off state and the second spring 21 is unloaded.

Figure 3:
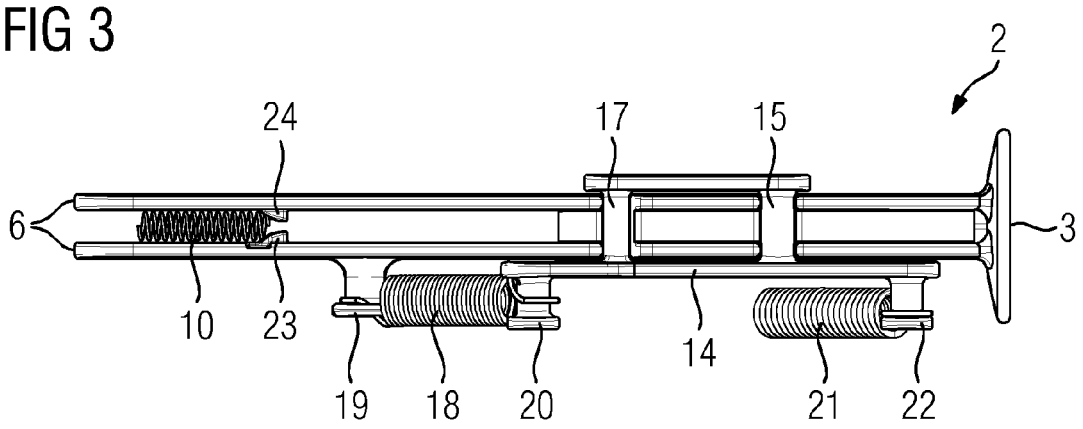
FIG. 3 shows a plan view of the switch-on button from FIG. 2.

FIG. 3 shows a plan view of the switch-on button 2 with its actuator 3 and the guide bars 4 and 5 as well as the bearing 15 and the locking bolt 17, wherein rotatable mounting of the locking element 14 with respect to the switch-on button is implemented by the bearing 15. Also shown in FIG. 3 is the compression spring 10 and latching lugs 23 and 24 which, as already explained in greater detail with reference to FIG. 1, are provided in the second recess 9 as a stop and latching arrangement.

Figure 4:
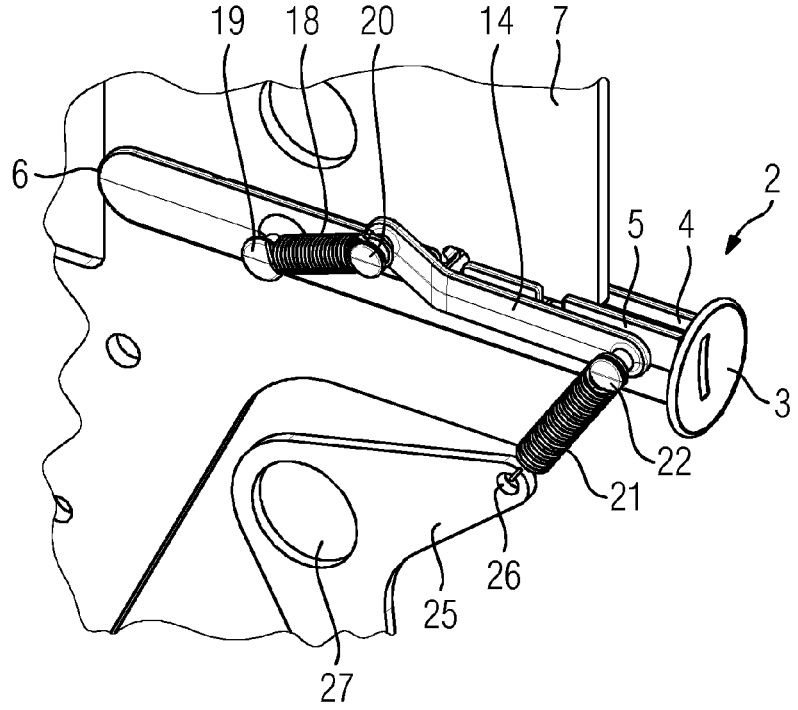
FIG. 4 shows the assembled locking mechanism in a first state of the circuit breaker.

FIG. 4 shows the locking mechanism 1 in its assembled state, wherein the second spring 21 is attached to a switch shaft lever 25 in a mounting opening 26, which switch shaft lever 25 is non-rotatably fixed to a switch shaft recess 27 on a circuit breaker switch shaft (not shown) so that when a drive movement is initiated from a stored-energy spring mechanism and the switch shaft rotates, the switch shaft lever 25 rotates with the switch shaft during execution of a switch-on operation. FIG. 4 shows the locking element 14 in its first position in which the first spring 18 is loaded such that force exerted by the first spring 18 on the locking element 14 is greater than the force exerted by the second spring 21 on the locking element 14, so that the locking element 14 is oriented parallel to the guide bars 4 and 5 of the switch-on button 2 and in particular the locking bolt 17 does not project above the guide bars 4 and 5.

Figure 5:
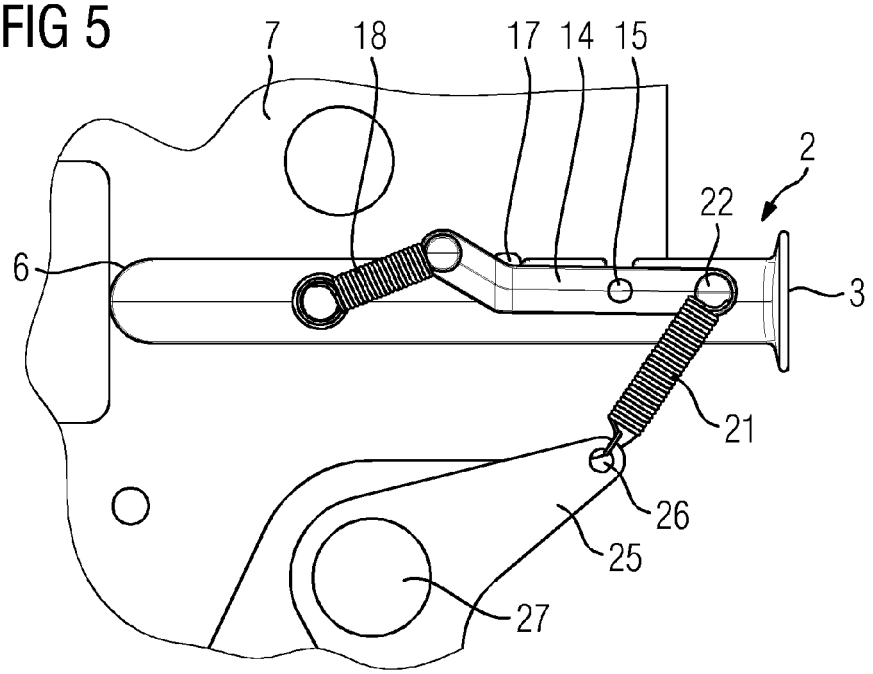
FIG. 5 shows a side view of the locking mechanism in the state of FIG. 4.

FIG. 5 shows a side view of the locking mechanism 1 in the same state as in FIG. 4 with the locking element and switch on button 2 or more specifically guide bars 4 and 5 oriented parallel to one another and with a force exerted by the first spring that is greater than the force exerted by the second spring in the state of the first position.

Figure 6:
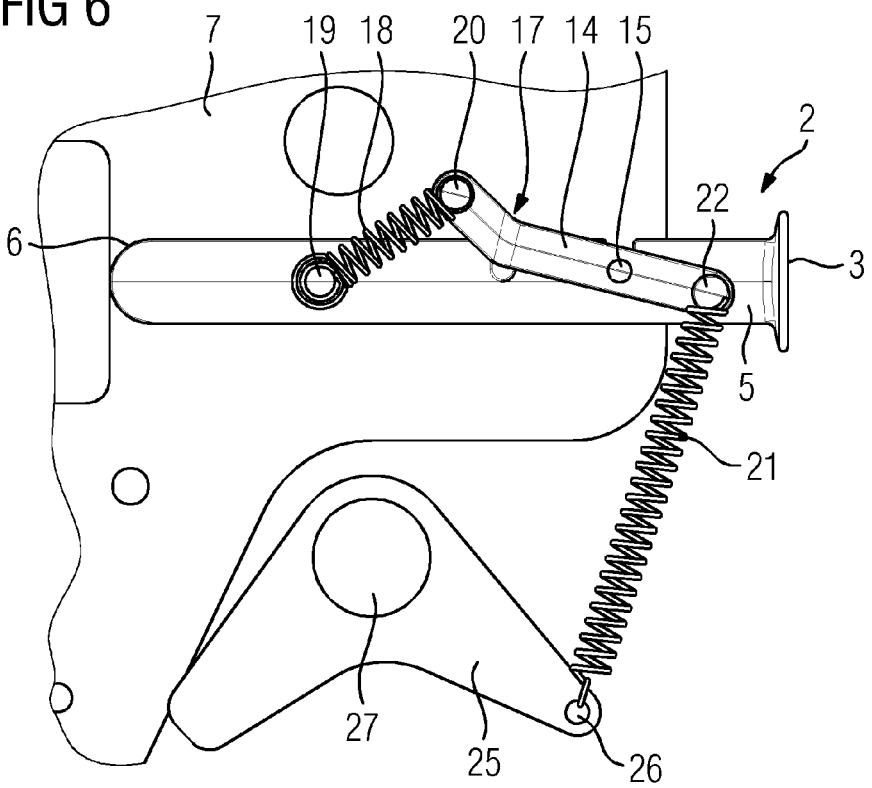

FIG. 6 shows another side view of the locking mechanism 1 after execution of a switching operation or more specifically actuation of the actuator 3 of the switch-on button 2 by an operator, wherein after execution of the switching operation of the circuit breaker by rotation of the switch shaft, the switch shaft lever 25 has likewise rotated and, as a result of rotation of the switch shaft lever 25, the second spring 21 is placed in its loaded state, the spring constant of the second spring 21 being selected such that, in said loaded state, the force of the second spring on the locking element 14 is greater than the spring force of the first spring 18 which, as a result of said rotation of the switch shaft lever 25 and the corresponding rotation of the locking element 14 around the bearing 15, is likewise further loaded and therefore exerts on the locking element 14 a corresponding restoring force which is however less than the force exerted by the second spring 21 on the locking element 14. When the locking element 14 rotates around the bearing 15 and the switch-on button 2 is returned by the compression spring 10 following execution of a switch-on operation, the locking bolt 17 engages in the locking recess 13 of the support plate 7 from FIG. 1 as long as the second spring 21 is loaded, so that re-actuation of the switch-on button 2 is effectively prevented by the locking of the locking bolt 17 in the locking recess 13 and opening of the circuit breaker is therefore likewise effectively prevented. Only after a switch-off operation of the circuit breaker, which involves rotation of the switch shaft and corresponding rotation of the switch shaft lever 25, is the second spring 21 unloaded, so that the restoring force exerted by the first spring 18 to return the locking element 14 from the second position shown in FIG. 6 to the first position shown in FIG. 5 is made possible and re-actuation of the switch-on button and switch-on of the circuit breaker is re-enabled.

LIST OF REFERENCE CHARACTERS

1 locking mechanism
2 switch-on button
3 actuator
4, 5 guide bars
6 actuation end
7 support plate
8 first recess
9 second recess
10 compression spring
11 stop
12 fastening means
13 locking recess
14 locking element
15 bearing
16 recess
17 locking bolt
18 first spring
19 first dome
20 second dome
21 second spring
22 third dome
23, 24 latching lugs
25 switch shaft lever
26 mounting opening
27 switch shaft recess

The invention claimed is:

1. A locking mechanism for a switch-on button of a circuit breaker, the locking mechanism comprising:

a first spring;

a second spring;

a locking element rotatably mounted on the switch-on button, said locking element, held directly in a first position by said first spring, allowing the switch-on button to be actuated and, in an ON state of the circuit breaker, can be placed directly in a second position by said second spring, wherein, in the second position, the switch-on button of the circuit breaker is locked against actuation; and said second spring engaging with said locking element and a switch shaft lever of the circuit breaker.

2. The locking mechanism according to claim 1, wherein said first spring engages with the switch-on button and said locking element.

3. The locking mechanism according to claim 1, wherein said locking element has a locking bolt and in the second position of said locking element, said locking bolt of said locking element engages in a locking recess of a support plate of the circuit breaker.

* * * * *